US005593515A

United States Patent [19]

Masumoto et al.

[11] Patent Number: 5,593,515

[45] Date of Patent: Jan. 14, 1997

[54] HIGH STRENGTH ALUMINUM-BASED ALLOY

[75] Inventors: Tsuyoshi Masumoto, 3-8-22, Kamisugi, Aoba-ku, Sendai-shi, Miyagi; Akihisa Inoue, 11-806, Kawauchijutaku, Mubanchi, Kawauchi, Aoba-ku, Sendai-shi, Miyagi; Hisamichi Kimura, Azatobeihashi; Yoshiyuki Shinohara, Tokyo; Yuma Horio, Hamamatsu; Kazuhiko Kita, Sendai, all of Japan

[73] Assignees: Tsuyoshi Masumoto; Akihisa Inoue, both of Miyagi; Teikoku Piston Ring Co., Ltd., Tokyo; Yamaha Corporation, Shizuoka; YKK Corporation, Tokyo, all of Japan

[21] Appl. No.: 411,164

[22] Filed: Mar. 27, 1995

[30] Foreign Application Priority Data

Mar. 29, 1994 [JP] Japan ..... 6-59145

[51] Int. Cl.[6] ..... C22C 21/00

[52] U.S. Cl. ..... 148/415; 148/403; 148/416; 148/437; 148/438; 420/528; 420/529; 420/538; 420/550; 420/551; 420/552; 420/553

[58] Field of Search ..... 148/415, 403, 148/416, 437, 438; 420/528, 529, 538, 550, 551, 552, 553

[56] References Cited

U.S. PATENT DOCUMENTS

| | | | |
|---|---|---|---|
| 5,053,085 | 10/1991 | Masumoto et al. | 148/403 |
| 5,240,517 | 8/1993 | Matsumoto et al. | 148/403 |
| 5,320,688 | 6/1994 | Masumoto et al. | 148/403 |
| 5,368,658 | 11/1994 | Masumoto et al. | 148/403 |
| 5,397,490 | 3/1995 | Masumoto et al. | 420/529 |
| 5,431,751 | 7/1995 | Okochi et al. | 420/551 |
| 5,432,011 | 7/1995 | DuBois et al. | 420/538 |

FOREIGN PATENT DOCUMENTS

| | | |
|---|---|---|
| 0445681A1 | 9/1991 | European Pat. Off. . |
| 0475101A1 | 3/1992 | European Pat. Off. . |
| 0534470A1 | 3/1993 | European Pat. Off. . |
| 0561375A3 | 9/1993 | European Pat. Off. . |
| 0587186A1 | 3/1994 | European Pat. Off. . |
| 6-256875 | 9/1994 | Japan . |

OTHER PUBLICATIONS

S. Takeuchi, "Quasi-Crystal," published on Jun. 12, 1992, pp. 78–79 & English Translation Thereof.

D. Shechtman, et al., "Metallic Phase With Long-Range Orientational Order and No Translational Symmetry", Nov. 12, 1984, Physical Review Letters, vol. 53, No. 20, pp. 1951–1953.

Alok Singh et al., "Quasicrystalline and crystalline phases and their twins in rapidly solidified Al-Mn-Fe alloys", Journal of Non-Crystalline Solids, vol. 153 & 154, No. 2, Feb. 1993, pp. 86–91.

K. H. Kuo et al., "Quaiscyrstals and Imperfectly Ordered Crystals", Materials Science Forum, vol. 150–151, 1994, pp. 15–34.

D. H. Kim et al., "Quaiscrystalline and related crystalline phases in rapidly solidified Al-Fe alloys", Philospohical Magazine A, vol. 69, No. 1, Jan. 1994, pp. 45–55.

*Primary Examiner*—David A. Simmons
*Assistant Examiner*—Robert R. Koehler
*Attorney, Agent, or Firm*—Finnegan, Henderson, Farabow, Garrett & Dunner, L.L.P.

[57] ABSTRACT

A high strength aluminum-based alloy, which having a composition of the general formula: $Al_{bal}Q_aM_bX_cT_d$, wherein Q represents at least one element selected from the group consisting of Mn, Cr, V, Mo and W; M represents at least one element selected from the group consisting of Co, Ni, Cu and Fe; X represents at least one element selected from rare earth elements including Y or Mm; T represents at least one element selected from the group consisting of Ti, Zr and Hf; and a, b, c and d represent the following atomic percentages: $1 \leqq a \leqq 7$, $0>5$, $0>c \leqq 5$ and $0>d \leqq 2$, and contains quasi-crystals in the structure thereof. The alloy of the present invention is excellent in the hardness and strength at both room temperature and a high temperature, and also in thermal resistance and ductility. In addition, it is usable as a high specific strength material having a high strength and a low specific gravity due to a small amount of addition of rare earth element or elements.

16 Claims, No Drawings

HIGH STRENGTH ALUMINUM-BASED ALLOY

BACKGROUND OF THE INVENTION

1. Field of the Invention

The present invention relates to an aluminum-based alloy having excellent mechanical properties such as a high hardness and a high strength.

2. Description of the Prior Art

An aluminum-based alloy having a high strength and a thermal resistance has hitherto been produced by a rapid-solidification technique such as a liquid quenching method. Particularly, an aluminum-based alloy produced by the rapid solidification technique as disclosed in Japanese Patent Laid-Open No. 275732/1989 is amorphous or microcrystalline. In particular, the microcrystalline alloy disclosed therein is in the form of a composite composed of a solid solution of an aluminum matrix, a microcrystalline aluminum matrix phase and a stable or metastable intermetallic compound phase.

However, although the aluminum-based alloy disclosed in the above-mentioned Japanese Patent Laid-Open No. 275732/1989 is an excellent alloy having a high strength, a high thermal resistance, a high corrosion resistance and an excellent workability as a high-strength material, its excellent characteristic properties as the rapidly solidifying material are impaired in a high-temperature range of 300° C. or above, and thus its thermal resistance, particularly, strength at a high temperature, has room for further improvement.

In addition, it is relatively difficult to improve the specific strength of the alloy disclosed in the above-mentioned Japanese Patent Laid-Open No. 275732/1989, since such an alloy contains an element having a relatively high specific gravity. Thus, a further improvement in or relating to the specific strength and ductility of the alloy is expected.

SUMMARY OF THE INVENTION

Therefore, the object of the present invention is to provide an aluminum-based alloy having an excellent thermal resistance, high strength at room temperature, high strength and hardness at a high temperature, excellent ductility and high specific strength by forming an aluminum-based alloy having such a structure that at least quasi-crystals are finely dispersed in an aluminum matrix.

The above-described problem can be solved by the present invention which provides a high strength aluminum-based alloy having a composition of the general formula:

$$Al_{bal}Q_aM_bX_cT_d$$

wherein Q represents at least one element selected from the group consisting of Mn, Cr, V, Mo and W; M represents at least one element selected from the group consisting of Co, Ni, Cu and Fe; X represents least one element selected from rare earth elements including Y or misch metal; T represents at least one element selected from the group consisting of Ti, Zr and Hf; and a, b, c and d represent the following atomic percentages: $1 \leqq a \leqq 7$, $0<b \leqq 5$, $0<c \leqq 5$ and $0<d \leqq 2$, and containing quasi-crystals in the structure thereof.

The quasi-crystals are in an icosahedral phase (I phase), decagonal phase (D phase) or approximant crystal phase of these crystal phases.

The structure of the aluminum-based alloy is composed of a quasi-crystal phase and any one phase of an amorphous phase, aluminum or a supersaturated solid solution of aluminum. The latter can be a composite (mixed phase) of an amorphous phase, aluminum and supersaturated solid solution of aluminum. The structure may contain an intermetallic compound formed from aluminum and other elements and/or intermetallic compounds formed from the other elements in some cases. The presence of the intermetallic compound is particularly effective in reinforcing the matrix or controlling the crystal grains.

DETAILED DESCRIPTION OF THE PREFERRED EMBODIMENTS

The aluminum-based alloy of the present invention can be directly produced from a molten alloy having the above-descried composition by a single-roller melting-spinning method, a twin-roller melting-spinning method, an in-rotating-water melt-spinning method, various atomizing methods, a liquid quenching method such as a spray method, a sputtering method, a mechanical alloying method, a mechanical grinding method or the like. The cooling rate which varies a little depending on the composition of the alloy is usually about $10^2$ to $10^4$ K/sec in such a method.

In the aluminum-based alloy of the present invention, the quasi-crystals can precipitate from the solid solution of the aluminum-based alloy of the present invention by heat-treating the rapidly solidified material obtained by the above-described method or by a thermal processing, for example, by compacting the rapidly solidified material and extruding the resultant compact. The temperature in this step is particularly preferably 360° to 600° C.

The detailed description will be made on the reasons for the limitation in the present invention.

A reason for limiting the atomic percentages in the above-mentioned general formula to 1 to 7% of a, 5% or below (excluding 0%) of b, 5% or below (excluding 0%) of c and 2% or below (excluding 0%) of d is that when the atomic percentages are in these ranges, the strength of the alloy is higher than that of an ordinary high-strength aluminum alloy available on the market while the high ductility is kept even at room temperature or 300° C. or higher. Particularly preferred range is: $3 \leqq (a+b+c+d) \leqq 7$.

The element Q which is at least one element selected from the group consisting of Mn, Cr, V, Mo and W is indispensable for the formation of the quasi-crystals. By combining the element Q with an element M which will be described below, the formation of the quasi-crystals is facilitated and the thermal stability of the alloy structure can be improved.

M represents at least one element selected from the group consisting of Co, Ni, Cu and Fe. By combining the element M with the element Q described above, the formation of the quasi-crystals is facilitated and the thermal stability of the alloy structure can be improved as in the case of Q element. The element M has only a low dispersibility in the main element Al; it is effective in reinforcing the Al matrix; and it forms various intermetallic compounds with the main element Al or other elements to contribute to the improvement in the strength and thermal stability of the alloy.

The element X is at least one element selected from rare earth elements including Y or misch metal (Mm). Such elements are effective in enlarging the quasi-crystal phase-forming zone into a low solute concentration area of the added transition metal and also in improving the refining effect by cooling the alloy. Thus, the element X is effective in improving the mechanical properties and ductility of the alloy by the improvement in the refining effect.

The element T is an element having a low dispersibility in the main element Al. It is effective in refining Al and also in improving the ductility of the alloy without impairing the mechanical strength and thermal resistance.

The amount of the quasi-crystals in the above-described alloy structure is preferably 20 to 70% by volume. When it is below 20% by volume, the object of the present invention cannot be sufficiently attained and, on the contrary, when it exceeds 70% by volume, the alloy will become brittle and, therefore, the obtained material might not be sufficiently processed. The amount of the quasi-crystals in the alloy structure is still preferably 50 to 70% by volume.

The average grain size in the aluminum phase or supersaturated aluminum solid solution phase is preferably 40 to 2,000 nm. When the average grain size is below 40 nm, the resultant alloy has an insufficient ductility, though its strength and hardness are high. When it exceeds 2,000 nm, the strength is rapidly reduced to make the production of the high strength alloy impossible.

The average grain size of the quasi-crystals and various intermetallic compounds which are contained if necessary is preferably 10 to 1,000 nm. When the average grain size is below 10 nm, they difficultly contribute to the improvement in the strength of the alloy and when such fine grains are present in an excess amount in the structure, a brittleness of the alloy might be caused. On the contrary, when it exceeds, 1,000 nm, the grains are too large to maintain the strength and the possibility of losing its reinforcing function is increased.

Thus, by restricting the composition to that shown by the above-mentioned general formula, the Young's modulus, strength at high temperature and room temperature, fatigue strength and so on can be further improved.

The alloy structure, quasi-crystals, grain size in each phase, dispersion state and so on of the aluminum-based alloy of the present invention can be controlled by suitably selecting the production conditions. Thus, by controlling these conditions, the alloy having desired properties such as strength, hardness, ductility and thermal resistance can be produced depending on the purpose.

Further, properties required of an excellent superplastic material can be imparted by controlling the average grain size in the aluminum phase or supersaturated aluminum solid solution phase in the range of 40 to 2,000 nm and the average grain size of the quasi-crystals or various intermetallic compounds in the range of 10 to 1,000 nm as described above.

The following Examples will further illustrate the present invention.

EXAMPLE 1

An aluminum-based alloy powder having each composition given in Table 1 was prepared with a gas atomizer. The aluminum-based alloy powder thus prepared was packed into a metallic capsule and then degassed to obtain an extrusion billet. The billet was extruded with an extruder at a temperature of 360° to 600° C. The mechanical properties at room temperature (hardness and strength at room temperature), mechanical properties at a high temperature (strength after keeping at 300° C. for 1 hour) and ductility of the extruded material (consolidated material) obtained under the above-described production conditions were examined to obtain the results given in Table 2.

TABLE 1

| Inventive | Composition (at. %) | | | | |
|---|---|---|---|---|---|
| sample No. | Al | Q | X | M | T |
| 1 | balance | Mn = 1.0 | Y = 1.5 | Co = 3.0 | Ti = 0.5 |
| 2 | balance | Mn = 1.5 | Ce = 2.0 | Co = 2.5 | Ti = 1.0 |
| 3 | balance | Mn = 2.0 | Gd = 1.0 | Fe = 4.0 | Ti = 1.5 |
| 4 | balance | Mn = 2.5 | Mm = 1.0 | Fe = 1.0 | Ti = 2.0 |
| 5 | balance | Mn = 3.0 | Mm = 1.0 | Ni = 1.0 | Zr = 0.5 |
| 6 | balance | Mn = 3.5 | La = 1.0 | Ni = 2.0 | Zr = 1.0 |
| 7 | balance | Mn = 4.0 | Nd = 0.5 | Fe = 1.0 | Zr = 1.5 |
| 8 | balance | Mn = 5.0 | Y = 2.0 | Cu = 2.5 | Zr = 2.0 |
| 9 | balance | Mn = 6.0 | Ce = 1.5 | Co = 1.5 | Hf = 0.5 |
| 10 | balance | Cr = 1.0 | Mm = 2.5 | Co = 2.0 | Hf = 1.0 |
| 11 | balance | Cr = 1.5 | La = 1.5 | Fe = 1.0 | Ti = 0.5 |
| 12 | balance | Cr = 2.0 | Mm = 1.0 | Ni = 2.0 | Ti = 1.0 |
| 13 | balance | Cr = 3.0 | Y = 1.0 | Co = 1.0 | Ti = 1.0 |
| 14 | balance | Cr = 3.5 | Ce = 1.0 | Fe = 3.0 | Ti = 1.5 |
| 15 | balance | Cr = 4.0 | Y = 3.5 | Ni = 3.0 | Ti = 2.0 |
| 16 | balance | Cr = 5.0 | Mm = 2.0 | Cu = 2.0 | Ti = 1.5 |
| 17 | balance | Mn = 1.0 Cr = 0.5 | Mm = 1.0 | Co = 2.0 | Zr = 0.5 |
| 18 | balance | Mn = 1.5 Cr = 0.5 | Ce = 1.2 | Fe = 1.0 | Zr = 1.0 |
| 19 | balance | Mn = 2.0 Cr = 1.0 | La = 1.0 | Co = 2.0 | Zr = 1.5 |
| 20 | balance | Mn = 0.5 Cr = 1.5 | Ce = 0.5 | Fe = 1.0 | Hf = 1.0 |
| 21 | balance | V = 1.0 | Ce = 1.0 | Co = 2.5 | Ti = 0.5 |
| 22 | balance | V = 1.5 | Y = 1.0 | Fe = 2.0 | Zr = 1.0 |
| 23 | balance | V = 3.0 | Ce = 1.0 | Co = 1.0 | Ti = 1.0 |
| 24 | balance | Mo = 2.0 | La = 1.0 | Ni = 1.0 | Ti = 1.0 |
| 25 | balance | Mo = 2.0 | Ce = 0.5 | Co = 1.5 | Zr = 1.0 |
| 26 | balance | W = 1.0 | Mm = 0.5 | Co = 3.0 | Ti = 1.0 |
| 27 | balance | W = 1.0 | Mm = 1.0 | Fe = 2.5 | Zr = 0.5 |
| 28 | balance | W = 1.5 | Ce = 0.5 | Co = 1.5 | Hf = 0.5 |

TABLE 2

| Inventive sample No. | Tensile strength (MPa) | Tensile strength 300° C. (MPa) | Hardness (Hv) | Elongation (%) |
|---|---|---|---|---|
| 1 | 870 | 325 | 290 | 16 |
| 2 | 810 | 320 | 292 | 22 |
| 3 | 880 | 340 | 298 | 18 |
| 4 | 960 | 335 | 320 | 15 |
| 5 | 890 | 321 | 288 | 21 |
| 6 | 820 | 335 | 295 | 19 |
| 7 | 850 | 341 | 280 | 18 |
| 8 | 920 | 345 | 295 | 16 |
| 9 | 940 | 350 | 297 | 16 |
| 10 | 1020 | 355 | 315 | 17 |
| 11 | 980 | 341 | 321 | 18 |
| 12 | 1030 | 339 | 295 | 17 |
| 13 | 990 | 345 | 295 | 16 |
| 14 | 890 | 348 | 285 | 18 |
| 15 | 980 | 336 | 292 | 20 |
| 16 | 930 | 339 | 288 | 21 |
| 17 | 920 | 348 | 286 | 18 |
| 18 | 920 | 345 | 297 | 17 |
| 19 | 920 | 341 | 285 | 19 |
| 20 | 930 | 339 | 275 | 18 |
| 21 | 770 | 305 | 280 | 16.2 |
| 22 | 870 | 325 | 288 | 15.2 |
| 23 | 920 | 330 | 330 | 17.0 |
| 24 | 920 | 300 | 290 | 16.0 |
| 25 | 970 | 310 | 310 | 17.0 |
| 26 | 930 | 320 | 298 | 13.3 |
| 27 | 970 | 335 | 310 | 14.0 |
| 28 | 980 | 315 | 315 | 12.7 |

It is apparent from the results given in Table 2 that the alloy (consolidated material) of the present invention has excellent hardness and strength at room temperature and also excellent strength and ductility at a high temperature (300° C.). Also, it was found that although in the production of the consolidated materials, the alloys were subjected to heating, a change in the characteristic properties of the alloy by heating was only slight and the difference in the strength between room temperature and high temperature was also only slight. These facts indicate that the alloy has an excellent thermal stability.

The extruded material obtained under the above-described production conditions was cut to obtain TEM (transmission electron microscope) observation test pieces. The structure of the alloy and the grain size in each phase were observed. The results of the TEM observation indicated that the quasi-crystals formed an icosahedral phase (I phase) singly or a mixed phase comprising the icosaheral phase and a decagonal phase (D phase). An approximant crystal phase of these crystal phases was recognized depending on the kind of the alloy. The amount of the quasi-crystals in the structure was 20 to 70% by volume.

The alloy structure was a mixed phase of aluminum or supersaturated aluminum solid solution phase and the quasi-crystal phase. Depending on the kind of the alloy, various intermetallic compound phases were also found. The average grain size in aluminum or supersaturated aluminum solid solution phase is 40 to 2,000 nm. The average grain size in the quasi-crystal phase or intermetallic compound phase was 10 to 1,000 nm. In the composition wherein intermetallic compounds were precipitated, the intermetallic compounds were uniformly and finely dispersed in the alloy structure.

In the Examples of the present invention, the alloy structure and the particle size in each phase were controlled by the degassing (including the compaction during the degassing and heat processing in the extrusion step.

As described above, the alloy of the present invention is excellent in the hardness and strength at both room temperature and a high temperature, and also in thermal resistance and ductility. In addition, it is usable as a high specific strength material having a high strength and a low specific gravity due to a small amount of addition of rare earth element or elements.

Since the alloy has a high thermal resistance, the excellent characteristic properties obtained by the rapid solidification method and the characteristic properties obtained by the heat treatment or thermal processing can be maintained even when a thermal influence is exerted thereon in the course of the processing.

In the present invention, the aluminum-based alloy having a high strength and thermal resistance can be provided because of the special crystal structure thereof, which contains a specified amount of the quasi-crystal phase having a high thermal resistance and hardness.

What is claimed is:

1. A high strength aluminum-based alloy having a composition of the general formula:

$$Al_{bal}Q_aM_bX_cT_d$$

wherein Q represents at least one element selected from the group consisting of Mn, Cr, V, Me and W; M represents at least one element selected from the group consisting of Co, Ni, Cu and Fe; X represents at least one element selected from rare earth elements including Y or misch metal; T represents at least one element selected from the group consisting of Ti, Zr and Hf; and a, b, c and d represent the following atomic percentages: a is greater than or equal to 1, but less than or equal to 7, b is greater than 0, but less than or equal to 5, c is greater than 0, but less than or equal to 5, and d is greater than 0, but less than or equal to 2 , and containing quasi-crystals in the structure thereof.

2. A high strength aluminum-based alloy according to claim 1, which satisfies: $3 \leqq (a+b+c+d) \leqq 7$.

3. A high strength aluminum-based alloy according to claim 1, which has an elongation of at least 10%.

4. A high strength aluminum-based alloy according to claim 2, which has an elongation of at least 10%.

5. A high strength aluminum-based alloy according to claim 1, wherein the quasi-crystals are in an icosahedral phase (I phase), decagonal phase (D phase) or an approximant phase thereof.

6. A high strength aluminum-based alloy according to claim 1, wherein the amount of the quasi-crystals contained in the structure is 20 to 70% by volume.

7. A high strength aluminum-based alloy according to claim 1, wherein the structure is composed of a quasi-crystal phase and any one of an amorphous phase, aluminum and a supersaturated solid solution of aluminum.

8. A high strength aluminum-based alloy according to claim 7, which further contains various intermetallic compounds formed from aluminum and other elements and/or intermetallic compounds formed from other elements.

9. A high strength aluminum-based alloy according to claim 1, which is any of a rapidly solidified alloy, a heat-treated alloy obtained by heat-treating a rapidly solidified alloy, and a compacted and consolidated alloy material obtained by compacting and consolidating a rapidly solidified alloy.

10. A high strength aluminum-based alloy according to claim 2, which is any of a rapidly solidified alloy, a heat-treated alloy obtained by heat-treating a rapidly solidified alloy, and a compacted and consolidated alloy obtained by compacting and consolidating a rapidly solidified alloy.

11. A high strength aluminum-based alloy according to claim 3, which is any of a rapidly solidified alloy, a heat-treated alloy obtained by heat-treating a rapidly solidified alloy, and a compacted and consolidated alloy obtained by compacting and consolidating a rapidly solidified alloy.

12. A high strength aluminum-based alloy according to claim 4, which is any of a rapidly solidified alloy, a heat-treated alloy obtained by heat-treating a rapidly solidified alloy, and a compacted and consolidated alloy obtained by compacting and consolidating a rapidly solidified alloy.

13. A high strength aluminum-based alloy according to claim 5, which is any of a rapidly solidified alloy material, a heat-treated alloy obtained by heat-treating a rapidly solidified alloy and consolidated alloy obtained by compacting and consolidating a rapidly solidified alloy.

14. A high strength aluminum-based alloy according to claim 6, which is any of a rapidly solidified alloy, a heat-treated alloy obtained by heat-treating a rapidly solidified alloy, and a compacted and consolidated alloy obtained by compacting and consolidating a rapidly solidified alloy.

15. A high strength aluminum-based alloy according to claim 7, which is any of a rapidly solidified alloy, a heat-treated alloy obtained by heat-treating a rapidly solidified alloy, and a compacted and consolidated alloy obtained by compacting and consolidating a rapidly solidified alloy.

16. A high strength aluminum-based alloy according to claim 8, which is any of a rapidly solidified alloy, a heat-treated alloy obtained by heat-treating a rapidly solidified alloy, and a compacted and consolidated alloy obtained by compacting and consolidating a rapidly solidified alloy.

* * * * *

UNITED STATES PATENT AND TRADEMARK OFFICE

CERTIFICATE OF CORRECTION

PATENT NO. : 5,593,515

DATED : January 14, 1997

INVENTOR(S) : Tsuyoshi MASUMOTO et al.

It is certified that error appears in the above-indentified patent and that said Letters Patent is hereby corrected as shown below:

Claim 13, column 7, line 14, after "alloy" (first occurrence) insert --, and a compacted--.

Signed and Sealed this

Twenty-third Day of September, 1997

Bruce Lehman

*Attest:*

BRUCE LEHMAN

*Attesting Officer*

*Commissioner of Patents and Trademarks*